United States Patent [19]

Miller

[11] 4,151,812

[45] May 1, 1979

[54] ATTACHMENT FOR USE ON VETERINARIAN TABLES

[76] Inventor: John J. Miller, 207 W. Broadway, Inwood, Long Island, N.Y. 11696

[21] Appl. No.: 825,162

[22] Filed: Aug. 12, 1977

[51] Int. Cl.[2] ..... A61D 3/00

[52] U.S. Cl. ..... 119/103

[58] Field of Search ..... 119/103; 269/323, 326, 269/328

[56] References Cited

U.S. PATENT DOCUMENTS

| | | | |
|---|---|---|---|
| 1,062,109 | 5/1913 | Miller | 119/103 |
| 1,218,381 | 3/1917 | Dragoo | 119/103 |
| 2,279,012 | 4/1942 | Packchanian | 119/103 |
| 2,773,477 | 12/1956 | Michael | 119/103 |
| 3,286,693 | 11/1966 | Clarke, Jr. et al | 119/103 |
| 3,286,694 | 11/1966 | Laudy | 119/103 |
| 3,596,637 | 8/1971 | Swafford | 119/99 |
| 3,615,088 | 10/1971 | Compton | 119/103 X |

*Primary Examiner*—Hugh R. Chamblee

*Attorney, Agent, or Firm*—Haseltine, Lake & Waters

[57] ABSTRACT

An attachment positionable on the top surface of a standard veternarian operating table for receiving an animal with ventral side down having rear legs hanging over a rear portion of the attachment and forelegs stretched outward on a front portion of the attachment. The attachment is formed of a unitary body member defined by a rear portion, a front portion, a side member disposed about the periphery of said attachment, and support legs disposed at each end of the body member for independently adjusting the attachment in the vertical direction with respect to the top surface of the operating table. The rear portion of the attachment is substantially concave in cross-section with the widest opening occurring at one end of the body member, whereas, the front portion is formed substantially of a triangularly shaped flat surface extending from a central portion of said body member to a maximum area at the second end.

6 Claims, 8 Drawing Figures

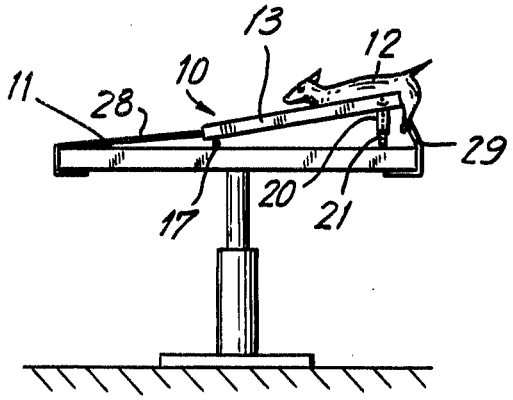
FIG. 1
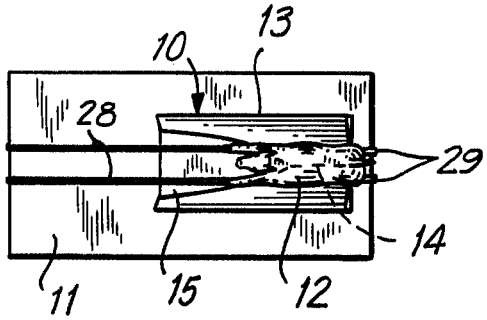
FIG. 2
FIG. 3
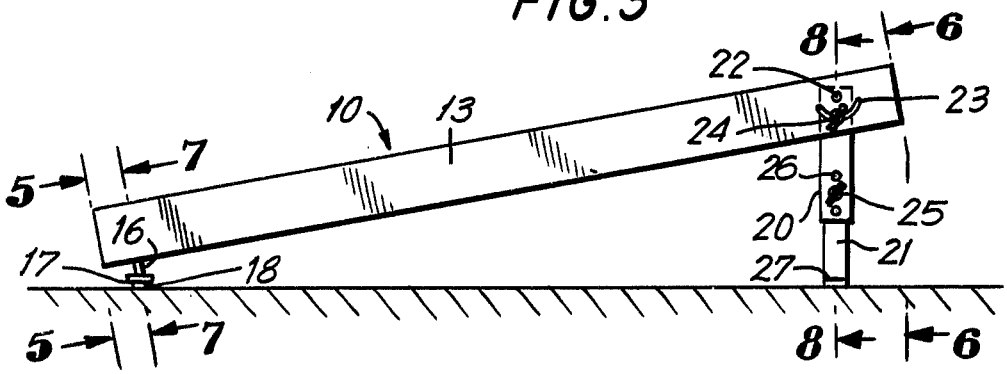
FIG. 5
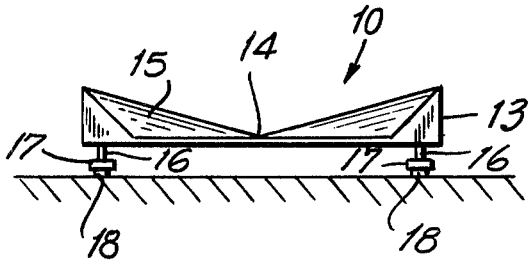

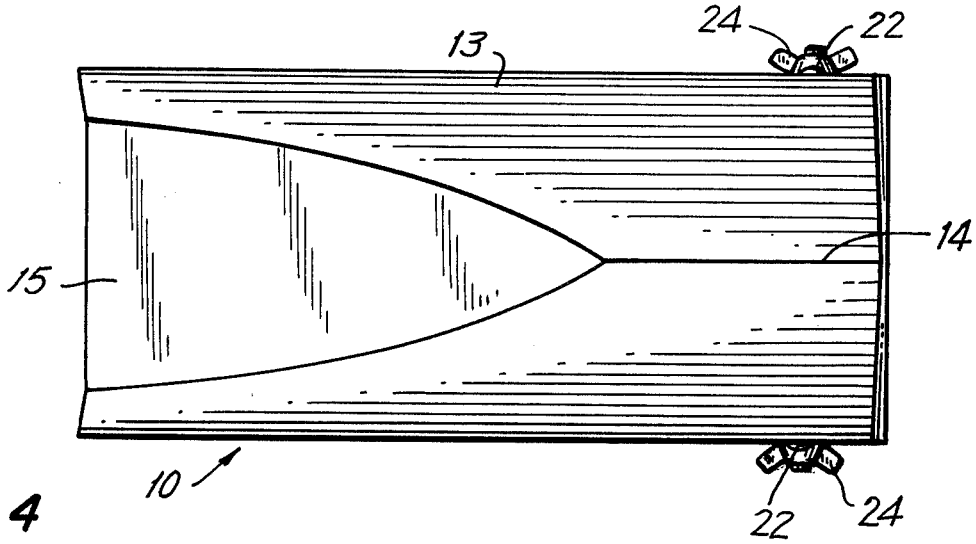
FIG. 4
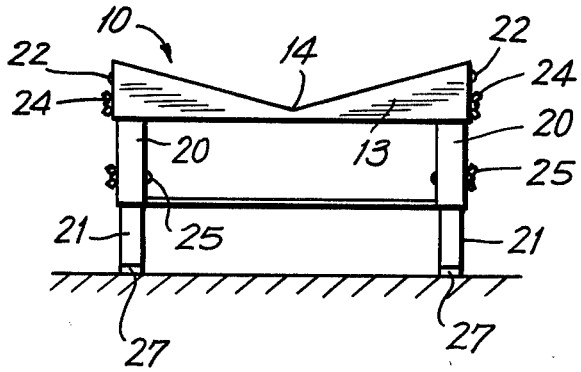
FIG. 6
FIG. 7
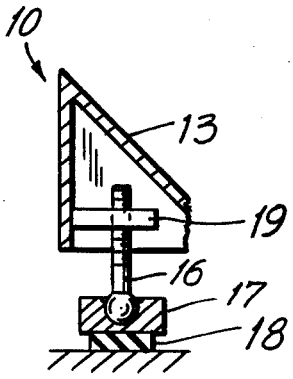
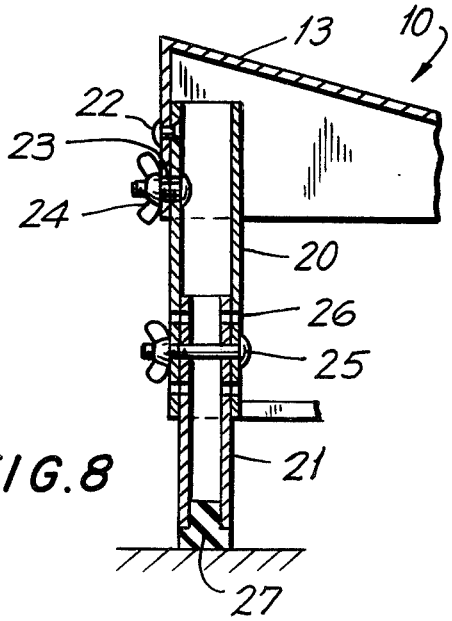
FIG. 8

ATTACHMENT FOR USE ON VETERINARIAN TABLES

BACKGROUND OF THE INVENTION

The present invention is directed to an attachment for use with a standard veterinarian operating table. More particularly, the present invention is directed to an adjustable attachment having a working surface used in positioning animals during surgical procedures and is employed in cooperation with a conventional veterinarian operating table.

In performing certain surgical procedures on animals it is important to position the animal in a fashion such that during surgery, that part to be worked upon is readily available to the veterinarian and the animal is positioned both comfortably and in a fashion which will not be injurious to him. Up until the present invention the prior art has failed to disclose an attachment which is able to position the animal independent of the surface of the operating table while permitting ready access to the animal for treatment with the ventral side down. For example, such prior art as described in U.S. Pat. No. 3,615,088 relates to an attachment for veterinary table provided with a clamp for engaging the table top and a multi-position attachment in the form of a flat board surface whose inclination is adjustable at one end with respect to the operating table. The attachment is for a tiltable operating table so as to regulate the height and angle of the operating table during the procedure but fails to employ the inventive concepts set forth hereinafter.

Accordingly, the present invention has endeavored to provide a simple and yet efficient manner in which the attachment cooperates with the operating table in performing operations particularly anal operations on small animals such as dogs and cats.

BRIEF SUMMARY OF INVENTION

The main object of the present invention is to provide an apparatus free from the defects of the prior art.

A further object of the present invention is to provide an attachment for use with a standard operating veterinarian table which will permit the surgeon to place the animal to be operated upon in a comfortable and safe position, while at the same time providing ready access to the area of the animal to be treated.

A further object of the present invention is to provide an attachment which permits positioning of the animal being operated upon to the surface of the veterinarian table, where the surgical procedure can be performed while the veterinarian is in an upright and comfortable position.

The principal features of the present invention are directed to an attachment for a veterinary table which is defined by a unitary body member in which one portion of the table has a concave, generally V-shaped cross-sectional profile; while the second portion is in the form of a flat substantially triangularly shaped surface. The sloping portion permits the animal's forward legs to be positioned thereover, as the animal is stretched out across the attachment, and the concave portion enables the surgeon to have ready access to the lower extremities of the animal being treated. Attachment support members in the form of legs on each corner of the attachment, permits adjustment that allows the attachment to be independently positioned irrespective of the orientation of the surface of the veterinarian table. This is accomplished through pivotable movement of the support legs with respect to the unitary body member, as well as vertical adjustment of the legs with respect to the surface of the table.

Other objects and advantages of the present invention will be more readily understood with reference to the accompanying specification, claims and drawings.

BRIEF DESCRIPTION OF THE DRAWINGS

FIG. 1 is a side elevational view of a conventional veterinarian table, with the inventive attachment positioned thereon.

FIG. 2 is a plan view of FIG. 1.

FIG. 3 is an enlarged elevational view of the inventive attachment.

FIG. 4 is a plan view of FIG. 3.

FIG. 5 is an end view looking in the direction of the line 5—5 on FIG. 3.

FIG. 6 is an end view looking in the direction of the line 6—6 on FIG. 3.

FIG. 7 is an enlarged sectional view on the line 7—7 on FIG. 3.

FIG. 8 is an enlarged sectional view on the line 8—8 on FIG. 3.

DETAILED DESCRIPTION OF THE INVENTION

According to FIG. 1, the attachment 10 is formed of metal material, preferably corrosion resistant sheet metal and consists of a body 13, one end of which is of V-shape cross-section 14 (see FIGS. 4–6.) for supporting the rump portion of the animal, with the hind legs depending from that end. From the center of the body 13 toward the opposite end, the V-shape expands into a wider flat portion 15 to support the chest and front legs of the animal, as shown in FIGS. 1 and 2. The front and rear legs of the animal are restrained by the usual ropes 28 and 29 of the standard operating table. The end of the table having the broad portion 15 is supported at a slightly lowered elevation by short vertically disposed leg members 16 which are pivotally supported at the bottom end thereof by a foot 17 provided with a rubber portion 18 for resting on the surface of the table 11 (see FIG. 7).

The foot portion 17 is movably supported to rest flat against the top surface of the table 11 regardless of the vertical adjustment of the other end of the body 13. As shown in FIG. 7, the top end of the leg portion is threaded through a block 19 secured to the inner face of the wall of the body 13. A foot is disposed at each corner of the widened portion 15 of the body 13. In FIGS. 6 and 8 the V-shaped portion 14 of the body 13 is provided with a vertically adjustable leg at each corner, and each of the legs consists of telescopically engaged leg portions 20 and 21. The top leg portion 20 is pivotally supported at its upper end by means of a pivot pin 22 to the side wall of the body 13. As shown in FIG. 3, the side wall is provided with an arcuate slot 23 concentric with pivot pin 22. Beneath the pivot pin 22, the leg portion 20 carries a thumb nut 24, which passes through the arcuate slot 23, permitting the extendable leg to be vertically positioned, regardless of the inclination of the body 13. The leg sections 20 and 21 are held in selected vertically extended positions by means of a thumb nut 25 selectively engageable through alignable holes 26, in the leg sections 20 and 21. The bottom end of the leg section 21 is provided with a rubber foot 27 for engaging the surface of the table 11.

The inventive apparatus can be used in canine procedures, for example: removal of anal glands, repairing of a perineal hernia and tumor removal.

For felines the procedures suitable when utilizing the present apparatus are for example: perineal erethostomy and tumor removal.

Among the advantages of the present invention are: The veterinarian is able to perform surgery standing up in a comfortable upright position, instead of being in a hunched over position. It is also to the veterinarians advantage to be able to adjust the proper height of the animal for a specific type of surgery.

The animal itself after being anesthetized will be lying ventral side down with rear legs hanging over the rear of the attachment and the forelegs stretched outward on the attachment. Ropes from under the original veterinarian table used for restraint will be used exactly the same with the inventive attachment. This positions the animal in the ideal position. While the animal is on the attachment if for any reason intravenous has to be given post, during or after surgery the outstretched forelegs permit easy accessibility to either vein in either leg.

If the animal is anesthetized by the use of holothane respirator the trachea tube must be inserted into the trachea of the animal. This attachment would also make it easier for insertion and continued anesthesia or respiration because the head of the animal would be lying straight and outstretched between the forelegs.

If there is too much pressure resting on the perineal nerve for too long a time, this may cause the nerve to pinch resulting paralysis of the animal. The rear of the inventive attachment is designed in "V" shape which relieves the direct pressure from the perineal nerve. For extensive surgery that requires many hours, a pad would be recommended for extra precautionary measures.

The inventive attachment is supported by rubber feet and rests on top of a standard veterinarian table in which the weight from the attachment, the animal and the ropes used for restraint is more than enough to keep it immobile.

Many modifications and variations of the present invention are possible in light of the above teachings. It is, therefore, to be understood that within the scope of the appended claims, the invention may be practiced otherwise than as particularly described.

What is claimed is:

1. An attachment for use with a standard veternarian operating table adapted to receive an animal with ventral side down having rear animal legs hanging over a rear portion of said attachment and forelegs stretched outward on a front portion of said attachment; said attachment being adjustably disposed on said operating table and including: a unitary body member defined by a rear portion; a front portion; and side panel means disposed about the periphery of said attachment; said rear portion being substantially concave in cross-section with the widest opening occurring at one end of said body member; said front portion being formed substantially of a triangularly shaped flat surface extending from a central portion of said body member to a second end wherein the maximum surface area being proximate to said second end; and support means disposed at each end of said body member for independently adjusting said attachment in the vertical direction with respect to the top surface of said operating table, said support means being defined by first and second respective pairs of leg means disposed at opposite ends of said body member; said first pair of leg means affixed at the front portion of said body member, being shorter in length than oppositely disposed second pair of leg means and each leg means of said first pair being provided with an elongated member affixed to said body member at a first end and pivotally connectable means formed at the second end connected to leg base means, for adjustably resting said first pair of leg means upon said table; said second pair of leg means being affixed at the end of said body member closest to said concave portion, being formed of positionable telescoping tubular members for vertical adjustment of said second pair of leg means with respect to said table; and slip resistant table surface contact means affixed to each lower extremity of said leg means.

2. An attachment apparatus as claimed in claim 1, wherein: said second pair of leg means being defined by an upper tubular member pivotally affixed to said body member; releasable fastening means adapted to fix said upper tubular member to said body member; a lower tubular member movable within the inside surface of said upper member, being fixable thereto at a desired level by releasable fastening means; and table surface contact means in the form of closure means affixed to said lower tubular member.

3. An attachment as claimed in claim 1, wherein: said lower tubular member and said upper tubular member, each being provided with a plurality of cooperating alignment holes for receiving fastening means therethrough to thereby affix the height of said leg means in response to the relative position of said tubular members.

4. An attachment as claimed in claim 1, wherein: positioning means being provided at said upper tubular member for independently positioning said second leg means with respect to the inclination of the surface of said body member.

5. An attachment apparatus as claimed in claim 1, wherein: said side panel means being provided with an arcuate slot for cooperation with a corresponding opening in said upper tubular member for receiving fastening means therethrough in response to arcuate movement of said leg means about pivot means formed at a point common to said upper tubular member and said side panel means of said body member.

6. An attachment as claimed in claim 5, wherein: said pivot means is affixed to said side panel means through said upper tubular member and being in spaced concentric alignment with said arcuate slot at a distance below said pivot means.

* * * * *